US009591907B2

(12) United States Patent
Johnson et al.

(10) Patent No.: US 9,591,907 B2
(45) Date of Patent: Mar. 14, 2017

(54) HAIR CLIP WITH APPENDAGE TO CREATE A FULLER THICKER PONY TAIL

(71) Applicants: Jake Johnson, Crawford, TX (US); Katie Johnson, Crawford, TX (US)

(72) Inventors: Jake Johnson, Crawford, TX (US); Katie Johnson, Crawford, TX (US)

( * ) Notice: Subject to any disclaimer, the term of this patent is extended or adjusted under 35 U.S.C. 154(b) by 0 days.

(21) Appl. No.: 14/500,225

(22) Filed: Sep. 29, 2014

(65) Prior Publication Data

US 2016/0088916 A1 Mar. 31, 2016

(51) Int. Cl.
*A45D 8/38* (2006.01)
*A45D 8/20* (2006.01)
*A45D 8/34* (2006.01)

(52) U.S. Cl.
CPC ..... *A45D 8/38* (2013.01); *A45D 8/20* (2013.01); *A45D 8/34* (2013.01)

(58) Field of Classification Search
CPC .. A41G 5/0026; A41G 5/0073; A41G 5/0093; A45D 2008/002; A45D 2008/004; A45D 5/0026; A45D 8/00; A45D 8/20; A45D 8/22; A45D 8/24; A45D 8/28; Y10T 24/4447
USPC ..... 132/223, 275, 277
See application file for complete search history.

(56) References Cited

U.S. PATENT DOCUMENTS 2,678,049 A * 5/1954 Eigenrauch ..... A45D 2/38 132/275
2,788,007 A * 4/1957 Bogardy ..... A45D 8/20 132/223
2,806,476 A * 9/1957 Thompson ..... 132/158
2,902,042 A * 9/1959 Halber ..... 132/133
5,642,740 A * 7/1997 Chen ..... 132/277
5,787,905 A * 8/1998 Yasuda ..... 132/277
5,881,741 A * 3/1999 Chen ..... 132/277
5,894,848 A * 4/1999 Schach ..... 132/223
5,975,092 A * 11/1999 Tsai ..... 132/275
D476,112 S * 6/2003 Denebeim ..... D28/40
2004/0226574 A1* 11/2004 Winn ..... A45D 8/22 132/277
2006/0124149 A1* 6/2006 Salisbury ..... A45D 8/20 132/277
2010/0012140 A1* 1/2010 Fitzpatrick ..... A45D 8/38 132/200
2011/0000499 A1* 1/2011 Hsu ..... 132/219
2011/0036370 A1* 2/2011 Lee ..... 132/201
2011/0041867 A1* 2/2011 Hsu ..... 132/276
2012/0298129 A1* 11/2012 Balboa ..... 132/277
2013/0014775 A1* 1/2013 Munoz ..... 132/210
2013/0247930 A1* 9/2013 Norman ..... 132/201

* cited by examiner

*Primary Examiner* — Todd E Manahan
*Assistant Examiner* — Jennifer Gill
(74) *Attorney, Agent, or Firm* — Usha S. Koshy

(57) ABSTRACT

A device to add height to a pony tail comprising a dome-shaped appendage integrally connected to a clip through a stem, the appendage having a plurality of arrow-shaped dowels of various shapes and lengths on its surface to trap and hold the hair in place over it so that the hair does not slide and fall to the sides, exposing the device. The clip of the device is comprised of a handle and two prongs connected at their bases through a round pin with a spring inserted around the pin to maintain the two prongs in continuous tension so that the clip with the appendage stays securely within the pony tail and does not fall off.

5 Claims, 3 Drawing Sheets

HAIR CLIP WITH APPENDAGE TO CREATE A FULLER THICKER PONY TAIL

FIELD OF THE INVENTION

The present invention generally relates to hair accessories that enhance hair styles. More particularly, the invention relates to a hair clip device with an appendage that when used with a pony tail enhances the appearance of the pony tail hair style by making the hair look thicker and fuller in addition to providing added height to the pony tail style.

BACKGROUND OF THE INVENTION

Adorning hair with accessories to enhance personal appearance especially by women is a tradition and practice in many cultures and societies around the world. For women and even some men who let their hair grow long, the main challenge is trying to keep their long hair manageable and away from their faces. The generally practiced methods of managing long hair have been either, gathering the hair and putting it up in a bun at the top back of the head, braiding, or tying up all the hair with a band or ribbon into a single length of hair, popularly referred to as a pony tail. Among all the means used to manage long hair, the most popular one has been, and is even today, the ponytail.

The pony tail method of managing long hair has evolved from one that used to be draped and hung loosely behind the neck and back as was commonly practiced by women from the 18$^{th}$ century, to one that is now held up high behind the back of the head using a band or ribbon and is considered a fashionable way to wear long hair. In an attempt to display the pony tail as a fashion statement, pony tail holders in a variety of styles, shapes, sizes and designs are currently marketed with success. However, the focus of these ponytail holders is to provide a means to show-case the long hair without changing the appearance of the structure of the hair in a pony tail.

Along with the change in style of the once humble pony tail, there has been a clamor to find innovative means to create volume, thickness and fullness to the pony tail hair. This need is more pronounced for individuals who have fine and sparse hair on their scalp because when such hair is tied up into a pony tail in the backs of their head, the pony tail tends to appear limp and unattractive. Some prior art describe hair accessories placed over the pony tail to create the appearance of a fuller pony tail as for instance the accessory described in U.S. Pat. No. 7,963,289 to, King. This accessory is visible when placed over the pony tail. The pony tail enhancer described in U.S. Pat. Appl. Pub. No. 2012/0138077 (Stuhler) uses a band to hold the device in place. U.S. Pat. No. 7,017,589 to, Minnelli describes a comb with a plurality of teeth and a roof portion inserted between the pony tail hairs to enhance the pony tail. In this device, the roof portion holding up the hair has a substantially smooth surface which will make the hair draped over it, slide off to the side and in all directions when the person is active or when the wind blows over the hair, thereby, exposing the roof portion of the device.

There is a need in the art for a pony tail enhancer that overcomes the deficiencies in the prior art devices. The, pony tail enhancer of the present invention has arrow-shaped dowels protruding from the appendage on which the hair rests to prevent the hair from sliding off the device and therefore, is an improvement over the prior art described. Further, the device of the present invention, has a sturdier clip part that will engage the hair more firmly than the tooth combs used in the prior art. The present invention thus overcomes a deficiency in the prior art for a pony tail enhancer that is functional and more effective in providing, fuller, thicker pony tails.

SUMMARY OF THE INVENTION

The present invention is a pony tail enhancer, hair clip device, having an appendage, to create a fuller, thicker, pony tail with the additional advantage of adding height to the pony tail. The device of the present invention is an improvement over prior art devices used to enhance a pony tail. In some prior art devices, the roof part of the devise that is used to hold up the pony tail has a smooth surface making it possible for the hair draped over that surface, to slide off the device, and leave the device exposed and looking unattractive. Additionally, the tooth combs on these devices used to hold the hair in place may easily dislodge resulting in the device falling off and leaving the pony tail looking flat and thin. The present invention overcomes these deficiencies in the prior art by providing a pony tail enhancing device with a gripping surface for the hair to rest on so that the hair does not slide off the device surface. The device of the present invention also replaces the combs and bands used in the prior art devices with a sturdy clip having prongs to hold the hair more securely in place on the pony tail.

The object of the present invention is to provide a pony tail enhancer system and method to create the illusion of a thicker, fuller pony tail to enhance a person's appearance and make a fashion statement.

A primary object of the present invention is to provide a pony tail enhancer device having an appendage with arrow-shaped dowels that can securely trap and hold the hair strands placed over it, in place, without those hair strands sliding off the device and exposing the device.

A further object of the present invention is to provide a pony tail enhancer device that has a sturdy hairclip component that can securely hold the top appendage of the device in place when the device is placed between the hairs of a pony tail without having the device dislodge and fall off during physical exercise or get knocked off by other means.

Yet another object of the present invention is to provide a pony tail enhancer device that gives height to a pony tail besides making the pony tail look thicker and fuller.

Another object of the present invention is to provide a pony tail enhancer device that is compact and easy to carry in a handbag or other bags so that it can be used effectively to enhance the pony tail at a moment's notice to make the pony tail appear thicker and fuller.

In the exemplary embodiment of the present invention, the pony tail enhancer hair clip device of the invention is comprised of an upper rounded and dome shaped, mushroom-like appendage part and a lower two pronged clip part. In this embodiment, the upper appendage part of the device is structurally attached to the bottom clip part through a stem portion with the upper end of the stem portion molded to the inside surface of the appendage part and the lower end of the stem portion molded to the base of one of the prongs on the clip part. In this embodiment of the invention, the two prongs of the clip part are held together by a round pin with a spring inserted around the pin to ensure that the two pronged pieces of the clip part are continuously in a state of tension to ensure that the clip maintains its hold on the hair placed between the two prongs of the clip.

In the exemplary embodiment of the present invention, the top surface of the appendage part of the invention having the rounded, dome shape and mushroom-like appearance is configured with several rows of arrow-shaped dowels of various shapes and lengths, arranged in rows. The primary purpose of these arrow-shaped dowels is to hold the hair strands draped over the top surface of the appendage in place and to ensure that they don't fall off to the sides and completely off the device, thus exposing the device through the hair strands.

In all embodiments of the present invention, the method of enhancing the pony tail is by first parting the hair of the pony tail that is held up by a band of some sort or a ribbon into an upper set of hair strands and a lower set of hair strands, flipping the upper set of hair strands over the head and while holding that set with one hand, inserting the open two pronged clip of the device of the invention into the mid section of the two sets of hair strands with the other hand and once the clip is closed, draping the upper set of strands over the appendage part of the device to give the pony tail, volume and height.

The foregoing summary of the embodiments of the present invention should not be construed to limit the scope of the invention. In this summary of the invention and in the specification in general the various references to the embodiments of the invention as, "the exemplary embodiment," "all embodiments" and all such references to embodiments of the invention do not necessarily refer to the same embodiment (s). Rather, these references to the various embodiments in general mean that a particular feature, structure, or characteristic described in conjunction with an embodiment is included in at least some embodiments, but not necessarily all embodiments of the invention. The objects, embodiments, and features of the present invention as described in this summary of the invention will be further appreciated and will become obvious to one skilled in the art when viewed in conjunction with the accompanying drawings, detailed description of the invention, and the appended claims.

DETAILED DESCRIPTION OF THE INVENTION

The present invention is a hair clip device for enhancing the pony tail of a wearer by providing thickness, fullness and height to their ponytail. The device of the invention overcomes some of the apparent deficiencies in the prior art devices used for enhancing pony tails. The device of the present invention is configured with an appendage having an ergonomic mushroom-like shape and design, dotted with arrow-shaped dowels on its top surface to hold the hair strands in place without the hair sliding and falling off to the sides as can happen with devices having a smooth surface. The device of the invention is compact and easy to carry in a small hand bag for use when needed. The hair clip device of the present invention can also be used to enhance other hair styles such as for example, inserted between the hairs piled up on the head as a bun creating the appearance of volume and fullness to the hair style.

Figure 1:
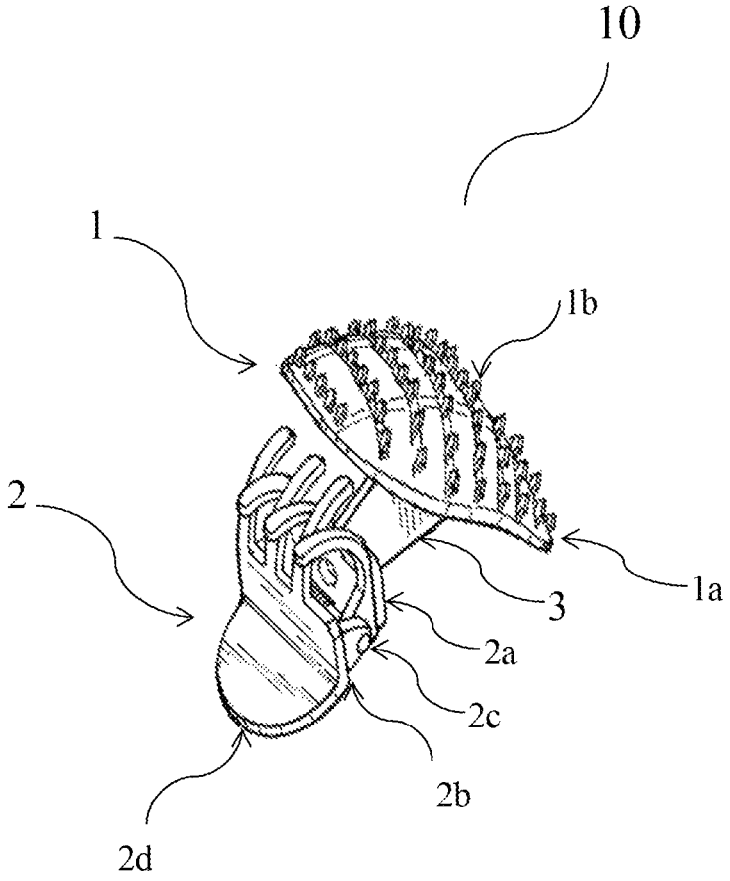
FIG. 1 is a perspective view of the exemplary embodiment of the pony tail enhancing hair clip device of the present invention.

Referring now to the drawings in which like elements are represented by like numerals in the various views of the device and its manner of use. More particularly, referring now to FIG. 1 which is a perspective view of the pony tail enhancing hairclip device 10 of the present invention, the device is comprised of an upper rounded and dome shaped, mushroom-like appendage 1 and a bottom clip 2 having two prongs, 2*a* and 2*b*. In this embodiment of the hair clip device 10, the appendage 1 is structurally connected to the clip 2 through a stem 3 with a top broad end and a bottom narrow end. The top broad end of the stem 3 is molded to the bottom end of the appendage 1 and the bottom narrow end of the stem 3 is molded to the base of the first prong 2*a* of the clip 2 to hold the appendage structure at an angle. The second prong 2*b* of the clip 2 is connected to the first prong 2*a* at their bases through a round pin 2*c* and both prongs are held together in continuous tension through a spring (not visible in this view) inserted around the pin 2*c* so that the clip 2 maintains its hold on the strands of hair and the base of the pony tail tied with the band near the scalp. In this embodiment of the invention, the second prong 2*b* of clip 2 has a substantially crescent-shaped handle 2*d* protruding outwardly. Handle 2*d* of clip 2 is used to open and close the two prongs 2*a* and 2*b* of clip 2 and also for holding the device with the fingers while inserting the clip into the pony tail. Further, in this embodiment of the invention, the top surface 1*a* of the appendage 1 has arrow-shaped dowels 1*b* of different sizes and lengths arranged in rows to hold the hair strands that are draped over it securely, when the hair clip device 10 is inserted between the hairs of the pony tail.

Figure 2:
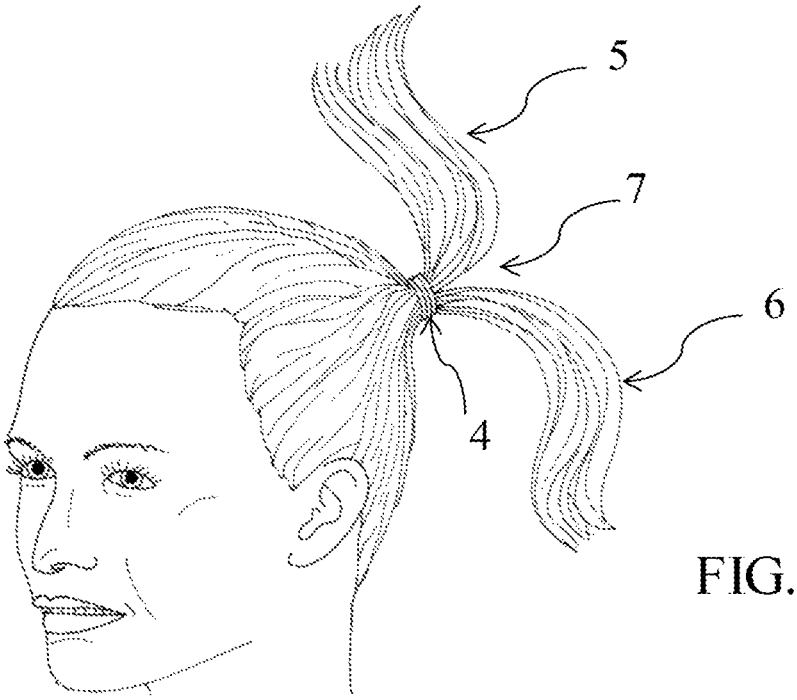
FIG. 2 perspective view illustrating the manner in which the hair of a pony tail is parted into an upper section and a lower section for the insertion of the device of the invention.

FIG. 2 is a perspective view illustrating the manner in which the pony tail hair is parted into two sections in preparation for the insertion of the pony tail enhancer hair clip device of the present invention. The pony tail is created first by gathering the strands of the long hair close to their roots and the scalp and tying them up into a single length of hair using a pony tail holder band 4. The pony tail thus formed is parted into an upper section 5 and a lower section 6 leaving a middle space 7 for insertion of the pony tail enhancer hair clip device of the invention.

Figure 3:
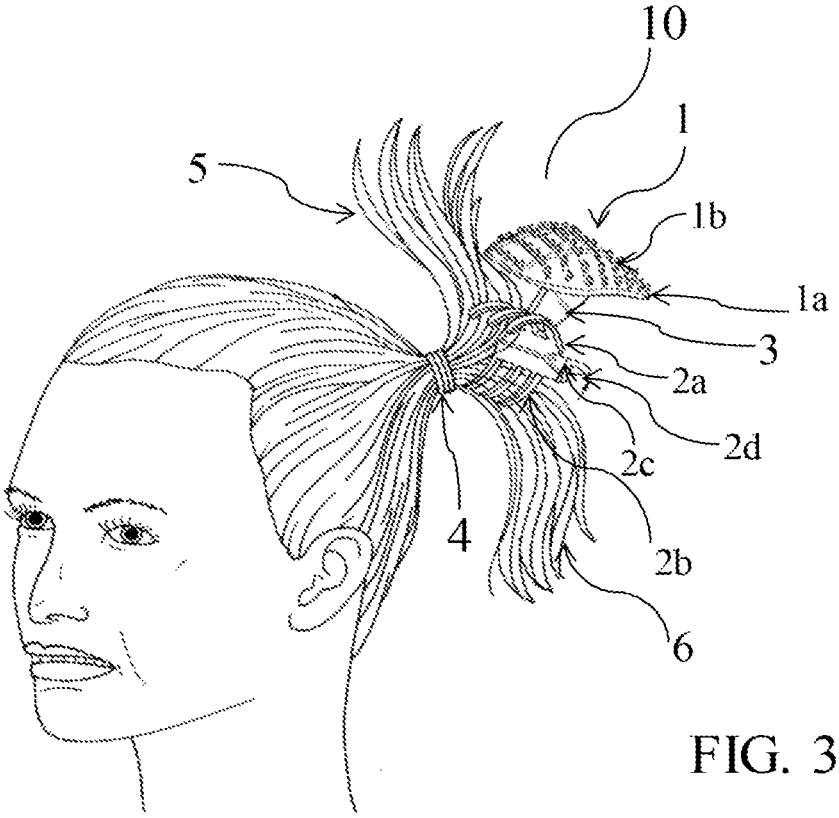
FIG. 3 is a perspective view illustrating the manner in which the pony tail enhancing hair clip device of the present invention is inserted between the parted hair strands of a pony tail.

FIG. 3 is a perspective view illustrating the manner in which the pony tail enhancing hair clip device 10 is inserted in the space between the parted hair sections, upper section 5 and the lower section 6 of the pony tail. Holding the parted hair upper section 5 up with one hand, the hair clip device 10 is held in the other hand with the appendage 1 facing upward and right below the upper hair section 5. Thereafter, the two prongs, 2*a* and 2*b* of the hair clip device 10 are opened using the handle 2*d* and the clip is inserted between the two parted hair sections, 5 and 6 through the space that was created between the sections when the pony tail hair was parted. The clip 1 is then pushed in closer to the hair next to the pony tail holder band 4 and the handle 2*d* released to let the prongs 2*a* and 2*b* grab and lock-in the hair next to the band 4 to anchor the hair clip device 10 on the pony tail. Once the clip 1 part of the device is held in place in the space between the two hair sections, 5 and 6 the hair strands in the upper section 5 are draped over the top surface 1*a* of the rounded, dome shaped appendage 1. The lower portion of the hair strands of the upper section 5 are trapped in between the rows of arrow-shaped dowels 1*b* on the top surface 1*a* of the appendage 1 of the hair clip device 10 and the upper portion of the hair in section 5 drapes over the appendage 1 hiding appendage 1 from sight.

Figure 4:
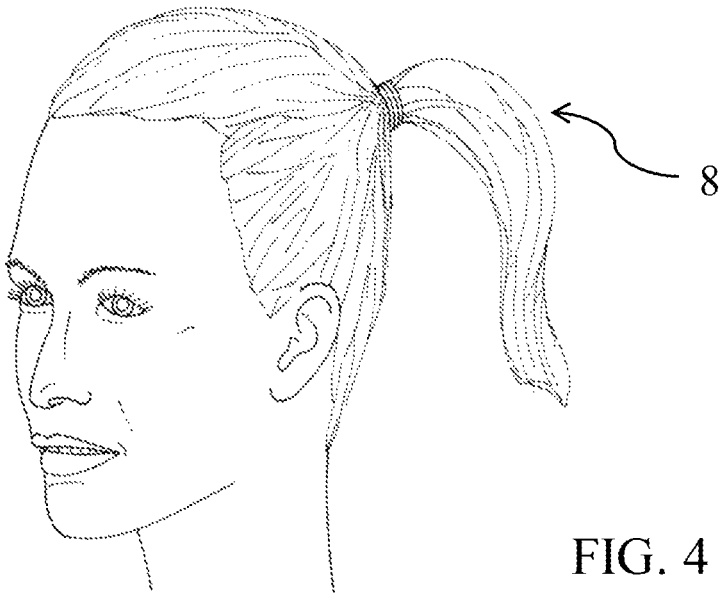
FIG. 4 is a perspective view of the appearance of a pony tail before the pony tail enhancing hair clip device of the present invention is inserted between the hair strands of the pony tail.
Figure 5:
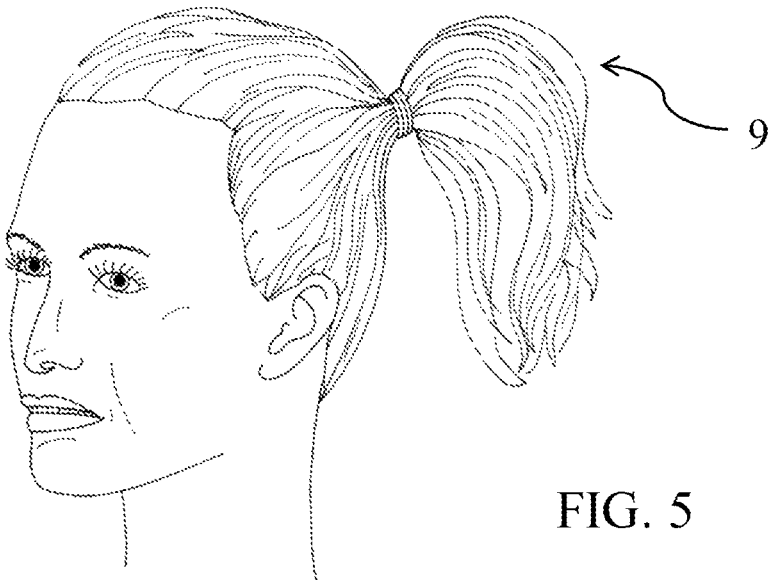
FIG. 5 is a perspective view of the thicker, fuller appearance of the pony tail after the pony tail enhancing hair clip device has been inserted between the hair strands of a pony tail.

FIG. 4 and FIG. 5 are before and after perspective views of a pony tail with FIG. 4 illustrating the appearance of the pony tail without the use of the pony tail enhancing hair clip device of the present invention and FIG. 5 illustrating the appearance of the pony tail after the insertion of the device in the pony tail.

FIG. 4 is a perspective view of the appearance of a pony tail 8 before the pony tail enhancing hair clip device of the present invention is inserted between the hair strands of the pony tail.

FIG. 5 is a perspective view of the thicker and fuller appearance of the transformed pony tail 9 after the pony tail enhancing hair clip device of the present invention has been inserted between the hair strands of the pony tail 8. The view also shows that the pony tail enhancer hair clip device has added height to the transformed pony tail 9 when compared to the view before of the pony tail 8 shown in FIG. 4. The dowels of the appendage of the hair clip device, keeps the hair draped over it, securely in place so that it is not visible through the hair.

The foregoing description of the invention through its figures and preferred embodiment should not be construed to limit the scope of the invention. It is to be understood that the embodiment of the present invention as described herein do not limit any application or scope of the invention and that the invention can be carried out and practiced in various ways and implemented in embodiments other than the ones outlined in the description above. It should be understood and obvious to one skilled in the art that alternatives, modifications, and variations of the embodiments of the present invention may be construed as being within the spirit and scope of the appended claims.

What is claimed is:

1. A device for adding height to a pony tail, said device comprising:

a dome shaped appendage structure;

said dome shaped appendage structure having a top surface with a plurality of arrow-shaped dowels to hold a plurality of hair of said pony tail securely in place over said dome shaped appendage structure;

a stem structure having a broad top end and an opposed narrower bottom end;

a clip structure consisting of: a first prong and a second prong;

said first prong and said second prong of said clip structure connected hingedly to each other at their bases through a round pivot pin and held together in continuous tension through a torsion spring inserted around said round pin structure; and a substantially crescent-shaped handle structure protruding outwardly from said second prong of said clip structure said broad top end of said stem structure integrally attached to a bottom end of said dome shaped structure; said narrower bottom end of said stem structure integrally attached to said first prong of said clip structure.

2. The device as described in claim 1 wherein the plurality of arrow-shaped dowels on the top surface of the dome-shaped appendage structure are arranged in rows to securely hold the plurality of pony tail hairs draped over the dome shaped appendage structure, thereby preventing said plurality of pony tail hairs from sliding to opposed sides of the dome shaped appendage structure and exposing the dome shaped appendage structure when the dome shaped appendage structure is inserted between the pony tail hairs to enhance and create volume and height to said pony tail.

3. The device as described in claim 1 wherein said broad top end of said stem structure integrally attached to said bottom end of said dome shaped appendage structure and said narrower bottom end of said stem structure integrally attached to said first prong of said clip structure holds said dome shaped appendage structure at an angle.

4. The device as described in claim 1 wherein said substantially crescent-shaped handle structure protrudes outwardly from the second prong of said clip structure and is used for opening and closing the first prong and the second prong of the clip structure.

5. A method for adding height to a pony tail style using the device of claim 1, said method comprising:

a) providing the device of claim 1, wherein the plurality of arrow-shaped dowels are configured to trap and hold the plurality of pony tail hairs, thereby preventing said pony tail hairs from sliding to opposed sides of said dome shaped appendage structure;

b) parting said pony tail hairs into an upper section and a lower section and holding said upper and lower sections in a parted position;

c) holding said device and placing said dome shaped appendage structure in a space created between said upper section and said lower section of said pony tail hairs;

d) opening said first and said second prongs of said clip structure with said handle structure and closing said first and said second prongs to trap and lock-in the plurality of pony tail hairs that lie close to a pony tail holder band, that forms said ponytail, to hold said dome shaped appendage structure in said space created between said upper section and said lower section of said pony tail hairs; and e) draping said upper section of said pony tail hairs over said arrow-shaped dowels on said top surface of said dome-shaped appendage structure to create a fuller and thicker appearance of said pony tail.

* * * * *